US007022205B2

(12) United States Patent
Ward et al.

(10) Patent No.: US 7,022,205 B2
(45) Date of Patent: Apr. 4, 2006

(54) APPARATUS AND METHOD FOR FORMING A BUTT SPLICE

(75) Inventors: James K. Ward, Rockton, IL (US); Timothy J. Searles, Broadhead, WI (US)

(73) Assignee: Martin Automatic Inc., Rockford, IL (US)

( * ) Notice: Subject to any disclaimer, the term of this patent is extended or adjusted under 35 U.S.C. 154(b) by 0 days.

(21) Appl. No.: 10/675,438

(22) Filed: Sep. 30, 2003

(65) Prior Publication Data

US 2004/0060641 A1 Apr. 1, 2004

Related U.S. Application Data

(60) Provisional application No. 60/415,204, filed on Oct. 1, 2002.

(51) Int. Cl.
*B65H 69/06* (2006.01)

(52) U.S. Cl. ..... 156/304.3; 156/304.1; 156/504; 156/505; 242/553; 242/556.1

(58) Field of Classification Search ..... 156/159, 156/304.1, 304.3, 505, 502, 504; 242/551, 242/553, 556.1
See application file for complete search history.

(56) References Cited

U.S. PATENT DOCUMENTS 3,939,032 A * 2/1976 Taitel et al. ..... 156/505
4,101,368 A * 7/1978 Page ..... 156/503
4,284,463 A * 8/1981 Wright ..... 156/502
4,519,858 A 5/1985 Martin
4,629,531 A * 12/1986 Kataoka ..... 156/504
4,801,342 A * 1/1989 Wheeler et al. ..... 156/159
5,314,568 A * 5/1994 Ryan ..... 156/504
5,322,230 A * 6/1994 Dylla et al. ..... 242/553
5,468,321 A * 11/1995 van Liempt et al. ..... 156/159
5,618,377 A * 4/1997 Kaneko et al. ..... 156/504
5,906,698 A * 5/1999 House et al. ..... 156/137
6,451,145 B1 * 9/2002 Forbes ..... 156/159
2003/0075276 A1 * 4/2003 Keene ..... 156/505
2003/0116256 A1 * 6/2003 Erickson ..... 156/157

* cited by examiner

*Primary Examiner*—Mark A. Osele
(74) *Attorney, Agent, or Firm*—McAndrews, Held & Malloy, Ltd.

(57) ABSTRACT

The present invention relates to a method and apparatus for splicing a web of layered material so that a new roll of material may be joined to an expiring web via a butt joint. A shear wheel is driven to ensure that the shear wheel positively rotates as it cuts across web material that is held against the side of an anvil. In the illustrated embodiment, a drive cable and shear wheel assembly are operably connected to a splicing apparatus, a portion of the drive cable being threaded through the splicing apparatus and wrapped around at least a portion of the shear wheel, the threaded drive cable being maintained under tension. The rapid movement of the shear wheel assembly, and the wrapping engagement between the taut threaded drive cable and shear wheel, forces the shear wheel to positively spin, thereby improving the cutting capabilities of the attached rotary cutter.

11 Claims, 9 Drawing Sheets

APPARATUS AND METHOD FOR FORMING A BUTT SPLICE

CROSS REFERENCE TO RELATED APPLICATIONS

This application claims the benefit of U.S. Provisional Application No. 60/415,204, filed Oct. 1, 2002, which is incorporated herein by reference in its entirety.

BACKGROUND OF THE INVENTION

The present invention pertains to joining together the leading end of a newly prepared web of material to the trailing end an expiring roll that is being fed to a continuous web processing operation. In particular, the present invention relates to a method and apparatus for evenly splicing a web of layered material, and more specifically a lightweight web material such as an airlaid, nonwoven web, which can be difficult to cut without tearing, so that a web from a new roll of material may be joined via a butt joint to the web of an expiring roll.

Various apparatus and methods for joining or splicing webs used in continuous web processing operations are known in the art. One common method of joining web materials is the lap joint, wherein the leading end of the new web is treated with a suitable adhesive, and at the proper time is manually lapped over the trailing end of the expiring roll. U.S. Pat. No. 4,519,858 describes an apparatus and method for making such lap joints.

A drawback of the lap joint is that it produces an undesirable double thickness of material at the joint. Such double thickness is particularly unsuitable for relatively A drawback of the lap joint is that it produces an undesirable double thickness of material at the joint. Such double thickness is particularly unsuitable for relatively thick web materials. Furthermore, because of restrictive operations downstream of the joint, certain types of materials, including two-ply pressure sensitive label stock, cannot be spliced in a lap joint Another common method of joining webs is through the use of a butt joint. With a butt joint, the leading end of the new roll is butted up against, but does not overlap, the trailing end of the expiring roll. An adhesive, such as a relatively thin, single-sided piece of adhesive tape is then used to join the butted ends together.

In the past, hand operations have had to be used to achieve a good-quality butt joint. Typically, a good quality butt joint has less than a one/one thirty-second inch gap between the butted ends of the webs that are being joined. The accuracy required has necessitated the stoppage of the running web from the expiring roll for a sufficient time to make a hand splice. However, as each roll expires, such stoppage results in significant loss of production time.

One apparatus and method for achieving an accurate butt joint is disclosed in U.S. Pat. No. 4,801,342 ("U.S. Pat. No. '342"), which is hereby incorporated by reference in its entirety. U.S. Pat. No. '342 discloses an apparatus wherein a portion of the web from a new roll is held against an anvil, the anvil having a cutting edge disposed at an angle to the path of travel of the expiring web running past the anvil. The invention disclosed in U.S. Pat. No. '342 also includes a knife wheel assembly that is mounted to one side of a splice wheel arm, the other end of the splice wheel arm being pivotably connected to a pneumatic cylinder. The knife wheel assembly includes a roller that has an axis that is perpendicular to the side of the anvil. The upper portion of the roller is a rotary or round knife that is aligned with the cutting edge of the anvil and which is perpendicular to the anvil's sides. As the pneumatic cylinder pivotably moves the splice wheel arm, the roller rotates against the web material that is being held against the adjacent side of the anvil. The rolling motion of the roller rotates the rotary or round knife along the cutting edge of the anvil, thereby trimming or cutting the web material so that the trimmed edge of the trailing or leading end of the web is aligned with and congruent to the cutting edge of the anvil.

The apparatus and method disclosed in U.S. Pat. No. '342 works very well for forming a butt joint for die cut, self-adhesive label stocks and heavier weight web stocks. However, for lighter weight webs, such as tissue or layered webs, including nonwoven airlaid webs, it is sometimes difficult for the device taught in U.S. Pat. No. '342 to evenly cut the web material without tearing. With such lightweight materials, the roller is often pushed, rather then rolled, across the web material that is being held against the adjacent side of the anvil, thereby causing the round or rotary knife to tear, rather than cut, the material. Additionally, in other lightweight web material applications, rather than cutting or trimming the web material, the rotating rotary or round knife merely pushes the material over the side the of the cutting edge of the anvil.

One alternative approach has been to utilize a hot wire to evenly cut or trim the web material. The use of a hot wire, however, can ignite materials that have some cellulose content, such as airlaid webs.

There is, therefore, a need for an improved apparatus that will evenly cut lighter-weight webs and permit such webs to be joined with a high-quality butt joint, while at the same time retaining all the commercial advantages achieved by the apparatus and method disclosed in U.S. Pat. No. '342.

Accordingly, it is an object of the present invention to provide an improved apparatus for forming a good-quality butt joint to join lightweight or layered webs, such as tissue or airlaid webs.

It is another object of the present invention to provide an improved apparatus for forming a butt joint that can cut lightweight or layered webs without tearing so that the web is evenly cut and can be joined to another web via a butt joint.

It is another object of the present invention to provide a method for accurately trimming or cutting lightweight or layered web materials without tearing so that a web material can be joined together via a butt joint.

These and other objects and advantages are provided by an improved apparatus and method for forming a butt joint that employs an anvil having a cutting edge and a shear wheel having a rotary cutting edge, and in which the rotary cutting edge rotates with the shear wheel and cuts a web along the anvil cutting edge when the web is secured against the anvil. The improvement comprises driving the shear wheel to ensure that the shear wheel is rotating as it moves across web material that is being held against the side of the anvil. In one embodiment, the improvement comprises wrapping a spring loaded shear wheel with a drive cable that is under tension to cause the shear wheel to positively rotate. In such an embodiment, the shear wheel may be provided with a circumferential groove that is configured to receive at least a portion of the drive cable and to prevent the drive cable from slipping off the shear wheel. Alternatively, the shear wheel may be operably driven via a gear drive, belt drive, or direct drive, such as a motor, configuration that ensures that the shear wheel positively rotates. The forced rotational speed of the shear wheel permits the rotary cutting edge to evenly cut or trim lightweight or layered webs without tearing.

BRIEF SUMMARY OF THE INVENTION

The present invention is directed to an improved apparatus and method of cutting or trimming web material. More specifically, the present invention allows for the quick formation of an accurate butt joint between an expiring roll of web material and a web of new material, and is particularly applicable to cutting or trimming relatively light weight layered and nonwoven materials in continuous web roll unwinding and splicing operations.

The improvement comprises driving a shear wheel to ensure that the shear wheel is positively rotating as it moves across web material that is being held against the side of the anvil. The preferred embodiment of the present invention includes a drive cable and a shear wheel assembly, both of which are operably connected to a butt splicing apparatus, such a butt splicing apparatus employs an anvil that has a cutting edge. The shear wheel assembly has a spring biased shear wheel that is configured for a wrapping engagement with at least a portion of the drive cable, the shear wheel including a rotary cutter that is configured for alignment with the cutting edge of the anvil. A portion of the drive cable is threaded through the butt splicing apparatus and around at least a portion of the shear wheel, said threaded cable being referred to hereinafter as threaded drive cable. In one embodiment of the invention, the threaded drive cable is locked at two distal locations, thereby preventing the cable from being pulled through the butt splicing apparatus. Preferably, only enough drive cable is threaded through the butt splice apparatus so that when locked at its distal ends by cable terminators, the threaded drive cable is taut. Furthermore, desired tautness in the threaded drive cable may be achieved through the use of at least one tension spring, the tension spring exerting a pulling force upon the threaded drive cable. Alternatively, rather than locking the ends of the threaded drive cable at two distal locations, each distal end of the threaded drive cable may be operably connected to a tension spring that also assists in achieving the desired tension in the threaded drive cable.

The combination of the rapid movement of the shear wheel assembly from a first position to a second position and the wrapping engagement of the taut threaded drive cable with the shear wheel forces the shear wheel to rotate. This rotational movement ensures that, when cutting web material, the shear wheel rolls, rather than being pushed, across the web material. Furthermore, the wrapping engagement between the taut threaded drive cable and shear wheel increases the rotational speed of the shear wheel, thereby further improving the ability of the rotary cutting edge to evenly cut or trim lightweight or layered web materials without tearing.

DETAILED DESCRIPTION OF THE INVENTION

Figure 1A:
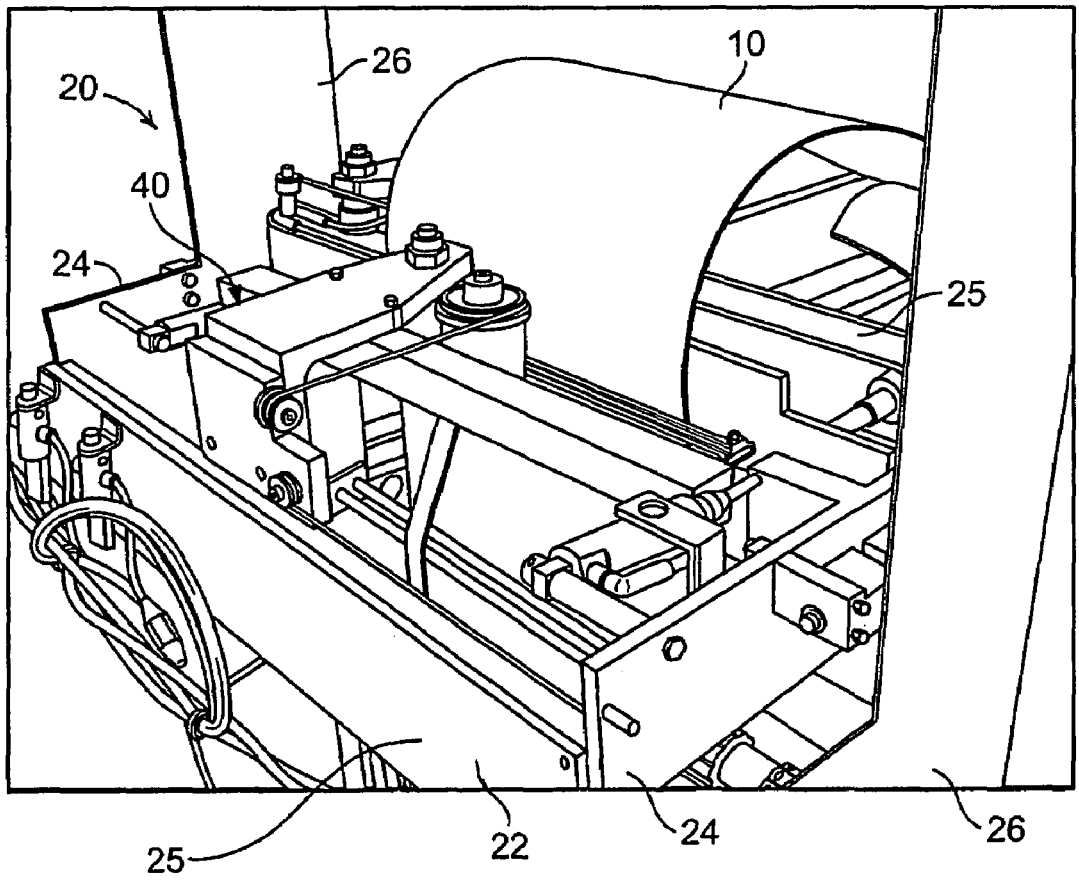
FIGS. 1*a*, 1*b* and 1*c* are perspective views of the illustrated embodiment of the present invention.
Figure 1B:
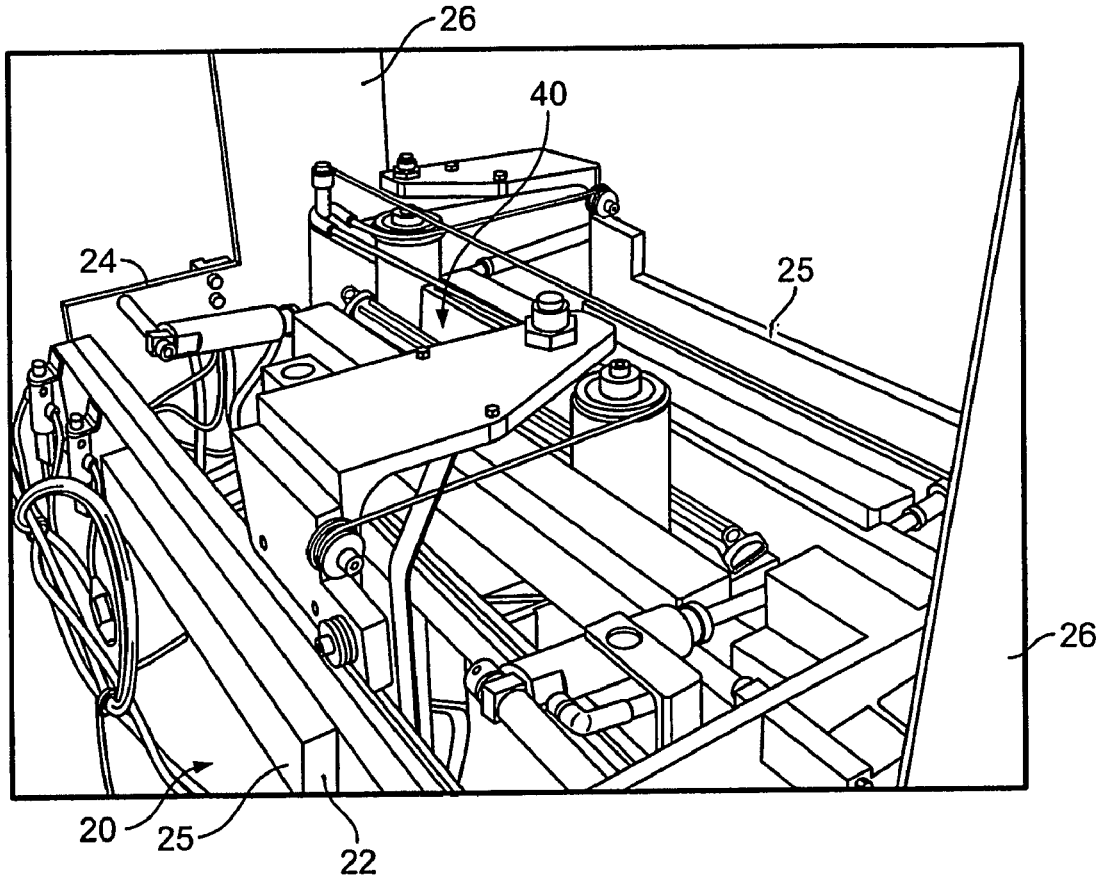
Figure 1C:
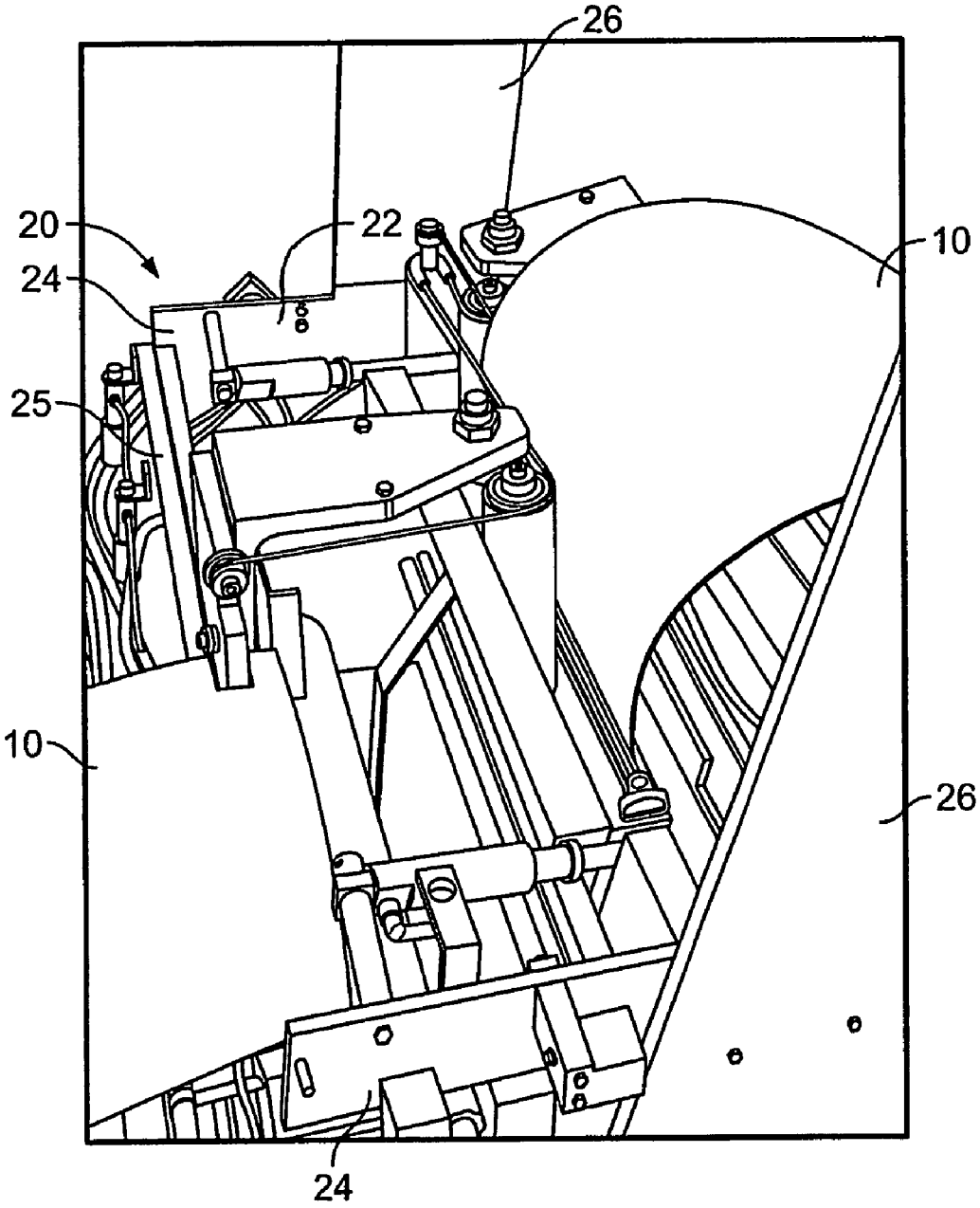

Referring now to FIGS. 1*a*–1*c* and 2, there is shown an apparatus 20 for forming a butt joint in accordance with the present invention. The apparatus 20 includes a splicer frame 22. In the preferred embodiment, the splicer frame 22 is generally open and rectangular and includes at least two side members 24 and at least two end members 25, the side members 24 and side members 25 being secured together at their ends. In one embodiment, the splicer frame 22 is operably supported by upright members 26 that extend upwardly from the plane of the splicer frame 22, the upright members being secured at their lower end to each of the side members 24.

An anvil 30 extends from one side of the splicer frame 22 to the other and is operably secured, at its ends, to each of the side members 24 midway between their ends. The anvil 30 is disposed so that it is adjacent to the path of travel of the running web as it passes through the apparatus 20. In the illustrated embodiment of the present invention, the plane of the anvil 30 is vertical and is generally perpendicular to the plane of the splicer frame 22. The first and second sides of the anvil are substantially parallel to the path of web travel and to each other. The leading end of the anvil 30 defines a cutting edge, the width of the cutting edge preferably being wider than the width of the web 10. The cutting edge of the anvil 30 is used in the cutting or trimming of the trailing end of an expiring roll of web material and the leading end of the new roll of web material so that the ends can be joined together via a butt joint, as explained more fully hereinafter.

Figure 2:
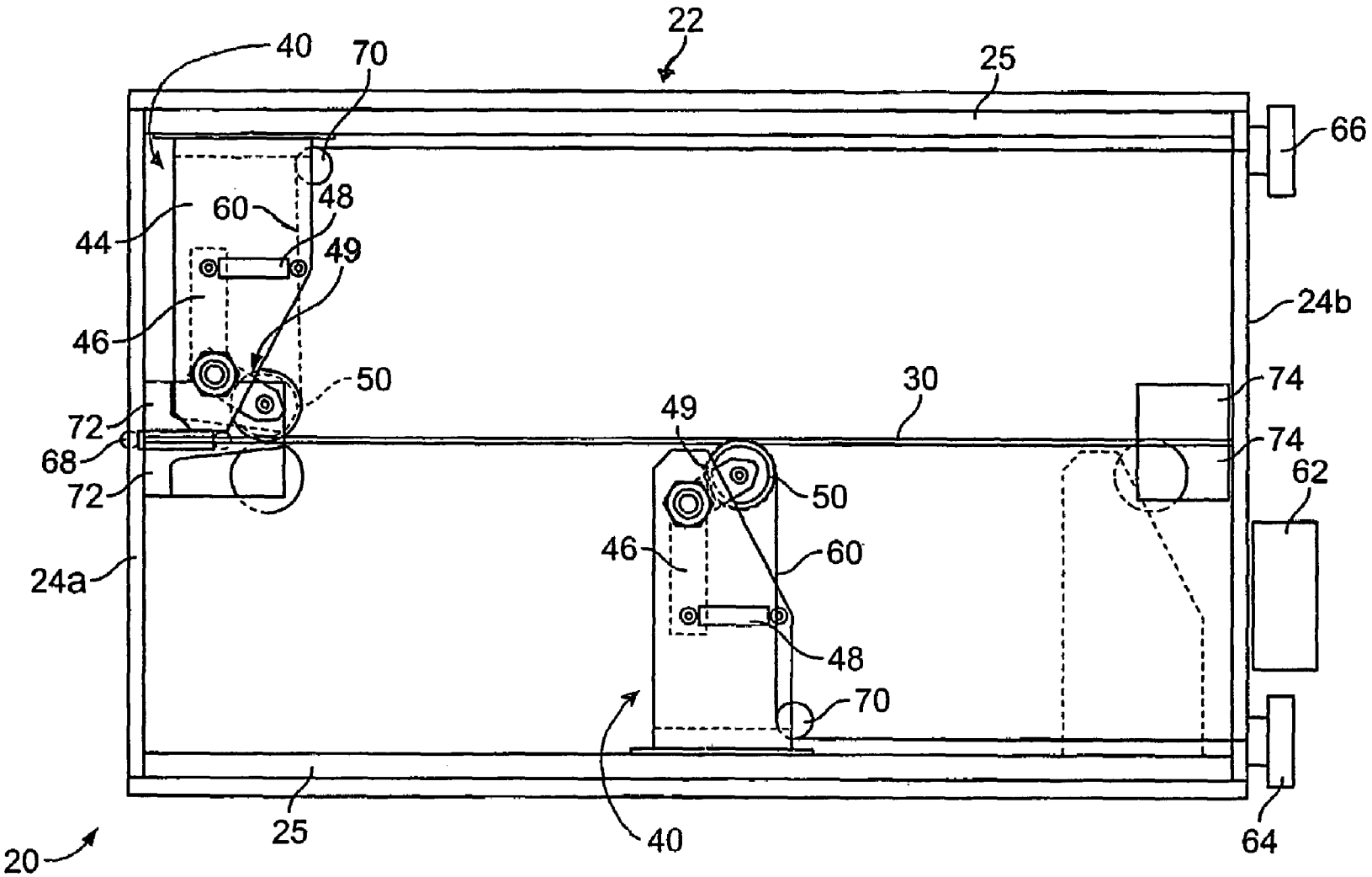
FIG. 2 is a top view of the illustrated embodiment of the apparatus of the present invention.

Referring now to FIG. 2, shear wheel assemblies 40 are operably connected to the splicer frame 22. Because the shear wheel assemblies 40 in the illustrated embodiment share similar construction and components, the same reference numbers are used hereinafter in describing them. In the preferred embodiment, each shear wheel assembly 40 is configured for linear movement along a bearing rail. In such an embodiment, the bearing rail is mounted to the frame 22. In one embodiment, the bearing rails may be mounted to the end members 25 of the splicer frame 22. Alternatively, the end members 25 may also act as the bearing rail for each adjacent shear wheel assembly 40. In the preferred embodiment, the shear wheel assembly is operably connected to one end of a double acting cylinder, the other end of the double acting cylinder being operably connected to a side member 24. The activation of the double acting cylinder forces the shear wheel assembly to move along the bearing rail. However, the present invention is not limited to being used in conjunction with the linear movement of the shear wheel assembly 40 along a bearing rail. For instance, the present invention may also be incorporated into a splicer apparatus in which the shear wheel is moved via the operation of a splice wheel arm assembly, as described in U.S. Pat. No. 4,801,342.

Each assembly 40 includes a housing 44 that is operably attached to a shear wheel arm 46. In the illustrated embodiment, the shear wheel arm 46 is connected at one end to an extension spring 48, while the other end of the shear wheel arm 46 is operably connected to a shear wheel 50. In the illustrated embodiment, a pivotable connection between the shear wheel arm 46 and the shear wheel 50 includes a spring steel flexure arm 49 that exerts a spring biased force on the shear wheel 50 so that, in operation, the shear wheel 50 remains engaged with the cutting edge of the anvil 30.

Figure 3:
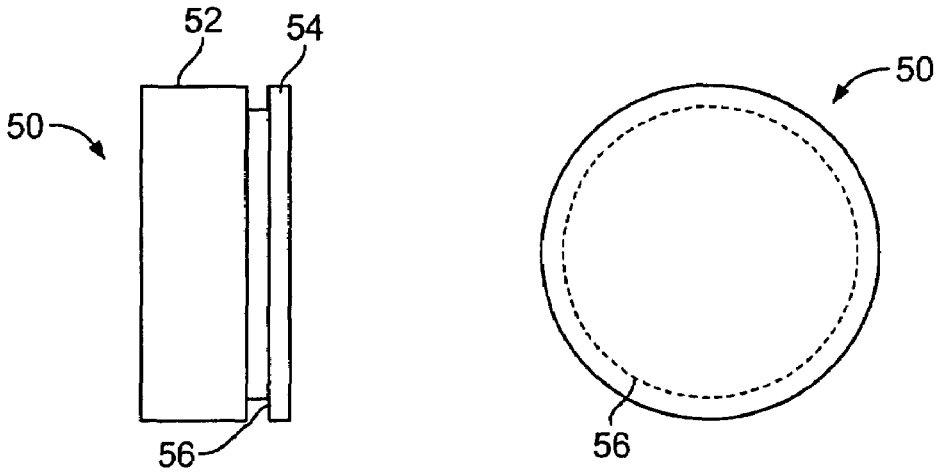
FIG. 3 is a side view of the illustrated embodiment of the shear wheel of the present invention.

FIG. 3 illustrates a side view of one embodiment of a shear wheel 50 for use with the present invention. As illustrated, the lower edge of the shear wheel 50 constitutes a rotary cutting edge 52 that rotates with the rotational movement of the shear wheel 50. In operation, the shear wheel 50 is positioned adjacent to the anvil 30 so that lower edge of the shear wheel 50 is disposed just above the cutting edge of the anvil 30. As the shear wheel 50 proceeds across the adjacent side of the anvil 30, and web material that is secured against the adjacent side of the anvil 30, the rotary cutting edge 52 of the shear wheel 50 cuts the web material along the cutting edge of the anvil 30, thereby trimming or cutting the web material so that the leading or trailing end of the web is substantially aligned with or congruent to the cutting edge of the anvil 30.

As also illustrated in FIG. 3, the upper end 54 of the shear wheel 50 includes a circumferential groove 56 that receives at least a portion of a taut threaded drive cable 60, as will be explained in more detail hereinafter. The circumferential groove 56 is configured to prevent at least a portion of the threaded drive cable 60 from slipping off of the shear wheel 50. In an effort to decrease the chance of slippage between the drive cable 60 and the shear wheel 50, the rap angle of the drive cable 60 around the shear wheel 50, and particularly the circumferential groove 56, is preferably at least 180°. In the preferred embodiment of the invention, the drive cable 60 is wrapped approximately one and a half times around the shear wheel 50.

Figure 4:
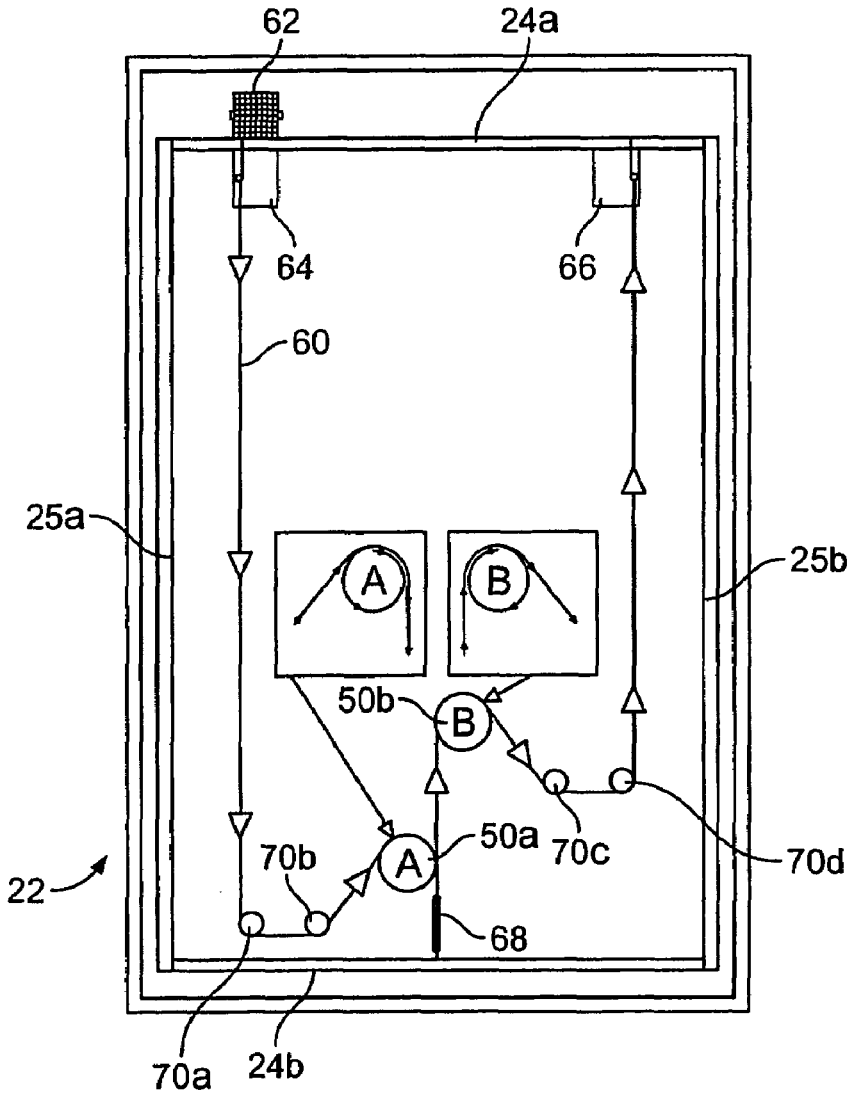
FIG. 4 is a schematic illustration of the threaded drive cable in one embodiment of the present invention.

FIG. 4 illustrates the path of the threaded drive cable 60 through the splicer frame 22 in one embodiment of the present invention. The drive cable 60 may be made from any suitable cable, belt, chain, or string material, as would be understood and appreciated by one skilled in the art. One suitable cable material is Kevlar. Excess drive cable 60 is wound about a cable spool 62 that is operably mounted to the splicer frame 22. In the preferred embodiment, the cable spool 62 is attached a side member 24*a*. A portion of the drive cable 60 is pulled from the cable spool 52 and is threaded through the splicer frame 22. However, the present invention is not limited to the use of a drive cable 60, and instead, in an alternative embodiment, the shear wheel may be driven by via a gear drive, belt drive, or direct drive, such as a motor, that is operably connected to the shear wheel 50 to force the shear wheel 50 to positively rotate.

Drive cable 60 removed from the cable spool 62 passes through or by an adjacent cable terminator 64 and transverses along an end member 25*a* until reaching a cable guide 70*a*, whereby the cable guide 70*a* redirects the drive cable 60 to a second cable guide 70*b*. The second cable guide 70*b* then directs the drive cable 60 to a first shear wheel 50*a*. As previously mentioned, in an effort to prevent slippage between the drive cable 60 and the first shear wheel 50*a*, the drive cable 60 is then preferably wrapped at least 180° about the first shear wheel 50*a*, with at least a portion of the drive cable 60 being seated in the circumferential groove 56 of the first shear wheel 50*a*.

In one embodiment of the present invention, the threaded drive cable 60 then extends from the first shear wheel 50*a* to a tensioning spring 68. The tensioning spring 68 is configured to assist in creating and maintaining tautness in the threaded drive cable 60.

The threaded drive cable 60 then extends from the tensioning spring 68 to a second shear wheel 50*b*, where the drive cable 60 is again preferably wrapped at least 180° about the second shear wheel 50*b*, with at least a portion of the drive cable 60 being seated in the circumferential groove 56 of the second shear wheel 50*b*. The threaded cable 60 is then guided by cable guides 70*c*, 70*d* to another cable terminator 66.

In the illustrated embodiment, the cable terminators 64, 66 are preferably mounted to the side members 24*a*, 24*b* of the splicer frame 22, with one cable terminator 64 being mounted adjacent to the end of a side member 24*a*, and another cable terminator 66 being mounted adjacent to the other side member 24*b*. Each cable terminator 64, 66 serves to removably clamp a distal end of the drive cable 60 that is threaded through the splicer frame 22. In an alternative embodiment, the cable terminators 64, 66 provide spring-loaded tension on the distal ends of the drive cable 60 to ensure that desired tautness of the threaded drive cable 60 is maintained. In another embodiment, rather than locking the drive cable 60 at distal ends, the cable terminators 64, 66 allow the taut threaded drive cable 60 to be pulled in a direction that facilitates the rotational movement of the shear wheels 50*a*, 50*b*.

For maintenance purposes, drive cable 60 that is threaded through the splicer frame 22 preferably remains operably connected to excess drive cable 60 that is stored in the cable spool 62, thereby allowing for easy replacement of worn threaded drive cable 60. In the illustrated embodiment of the present invention, worn threaded drive cable 60 may be replaced by loosening the threaded drive cable 60 from the cable terminators 64, 66. A pulling force is then exerted on a distal end of the threaded drive cable 60 so that worn drive cable 60 is pulled from the splicer frame 22, while simultaneously drawing and threading the attached excess drive cable 60 from the cable spool 62 into and through the splicer frame 22, and thus replacing the worn cable 60 along the cable guides 70*a*, 70*b*, 70*c*, 70*d*, shear wheels 50*a*, 50*b* and the cable tensioning spring 68. Once the desired amount of worn drive cable 60 has been removed from the splicer frame 22, and the excess replacement drive cable 60 has been properly threaded through the splicer frame 22, the cable terminators 64, 66 are locked onto the distal ends of the replacement threaded drive cable 60. The removed worn drive cable 60 may then subsequently be discarded or stored in a second cable spool.

Figure 5A:
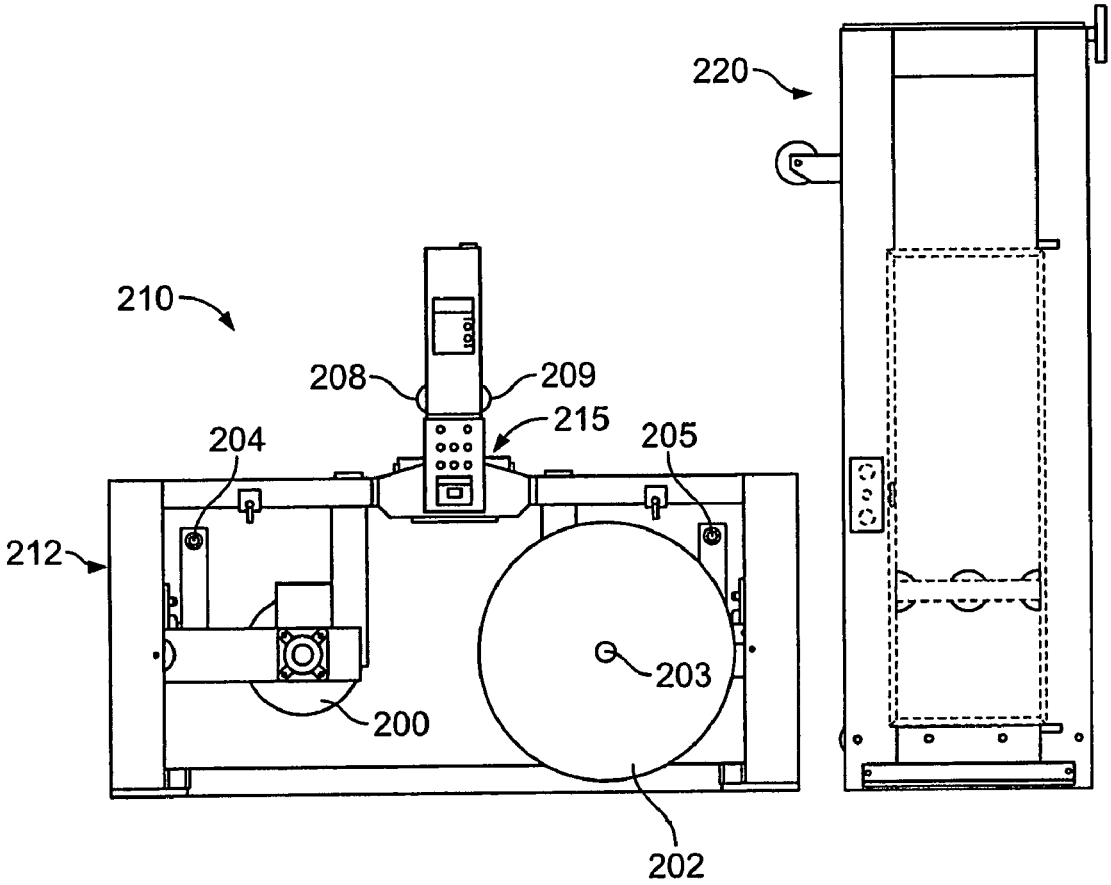
FIG. 5A illustrates a side view of a web splicer that may be used with the present invention.
Figure 7:
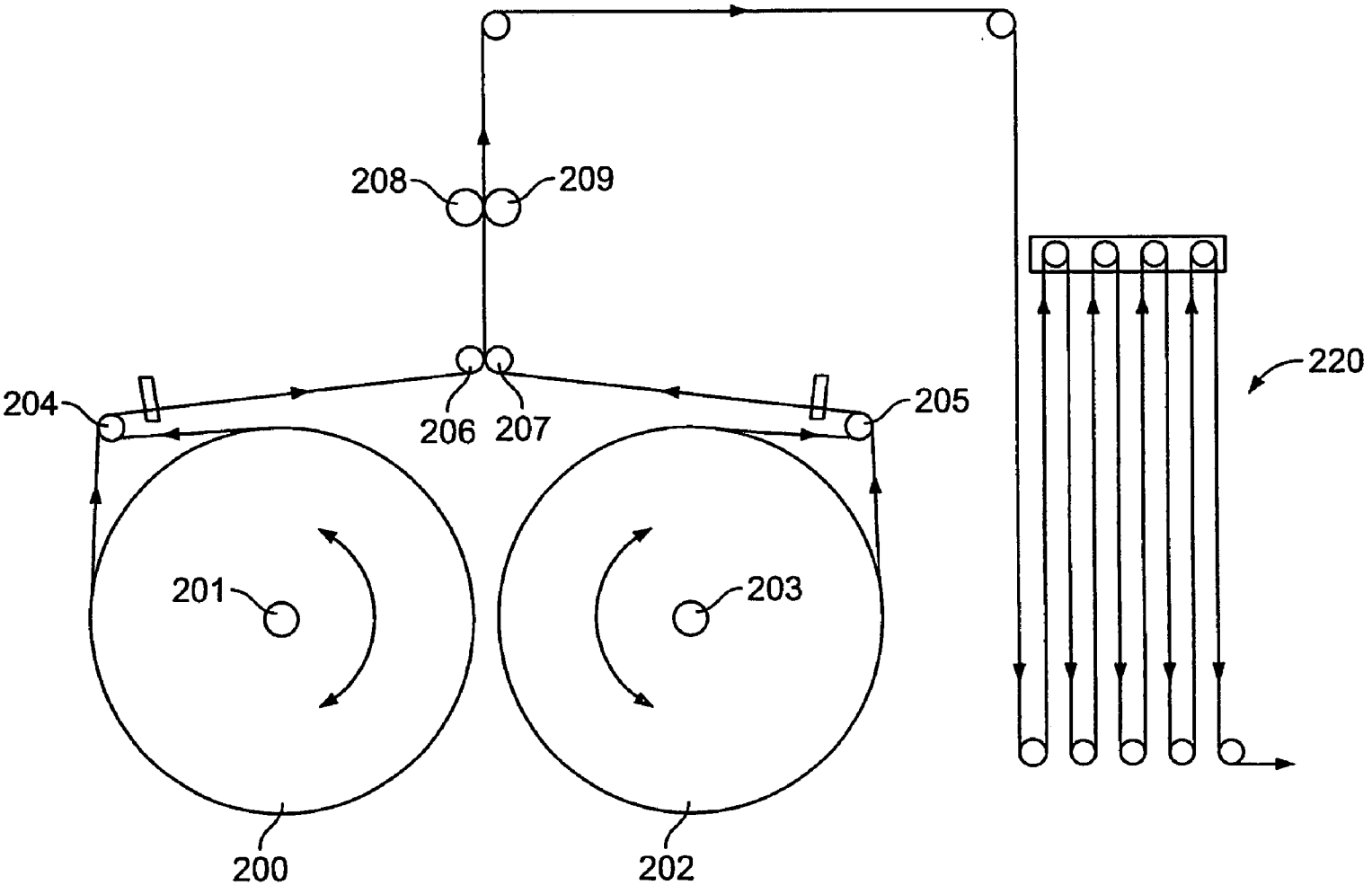
FIG. 7 is a schematic illustration of threaded rolls of web material in a web splicer device that is compatible with the present invention.

In the illustrated embodiment, during operation, one of the shear wheel assemblies 40 is used to trim or cut the leading end of a new roll of web material, while another shear wheel assembly 40 is used to cut or trim the trailing end of the expiring roll. Which shear wheel assembly 40 is used to trim or cut the new or expiring roll of web material depends on the location and path of the new and expiring roll in the web splicer, as illustrated in FIGS. 5A and 7. In the preferred embodiment, each shear wheel assembly 40 operates independently of any other shear wheel assembly 40, so that the movement of one shear wheel assembly 40 does not affect the position of another shear wheel assembly 40. This independence allows the leading end of a non-running new roll of web material to be cut or trimmed while the expiring roll continues to run.

Referring now to FIG. 2, when at a first position, the shear wheel assembly 40 preferably abuts and rests against a stop 72, the stop 72 being secured to the inside of the adjacent side member 24*a*. Similarly, when at a second position, the shear wheel assembly 40 and associated shear wheel 50 preferably abuts against a stop 74 that is secured to the inside of the opposing side member 24*b*. As the shear wheel assembly 40 rapidly moves from a first position towards a second position, as illustrated by phantom lines in FIG. 2, the combination of the rapid movement of the shear wheel assembly 40 and the wrapping engagement of the shear wheel 50 with the taut threaded drive cable 60, which is under tension, forces the shear wheel 50 to rotate. This rotation movement is as fast, if not faster than the rotational movement that would result from only the rolling engagement between the shear wheel 50 with web material being secured against the anvil 30. The increased rotational speed from the wrapping engagement of the drive cable 60 and the shear wheel 50 permits the rotary cutting edge to evenly trim the trailing and leading ends of the new and expiring webs without tearing, thereby enabling the ends of the webs to be joined together in a high quality butt splice.

Figure 5B:
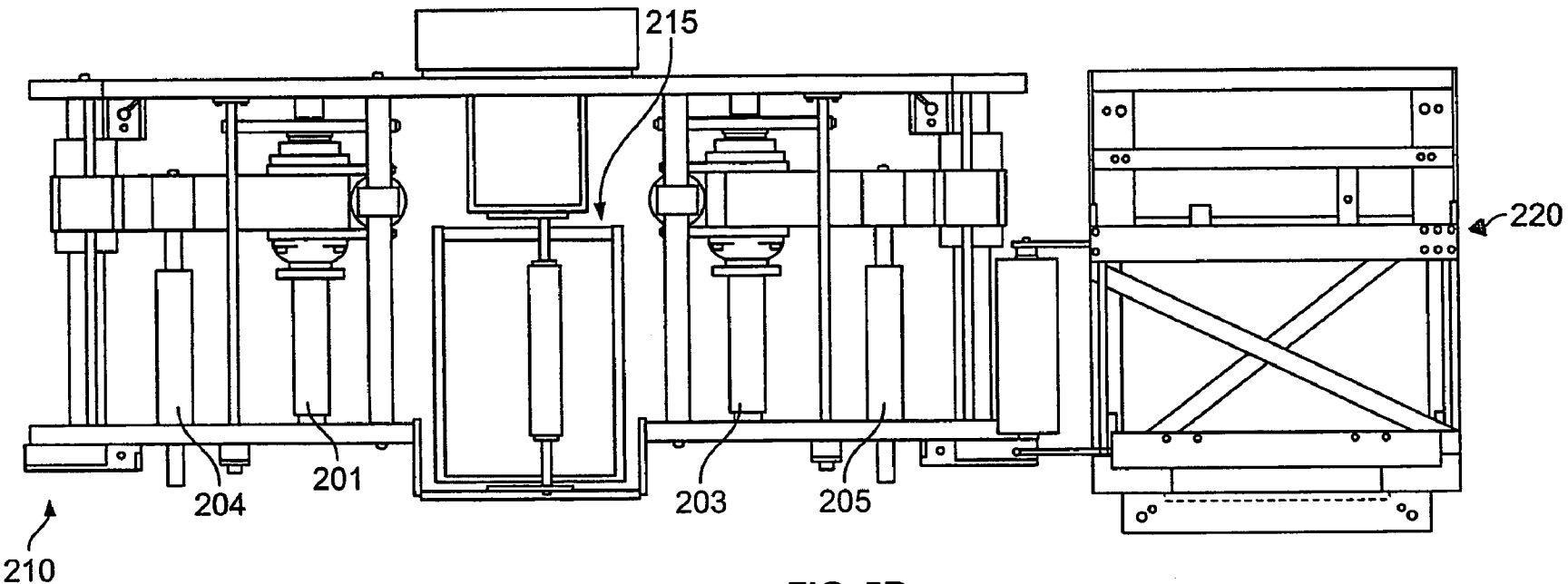
FIG. 5B illustrates a top view of a web splicer that may be used with the present invention.
Figure 6:
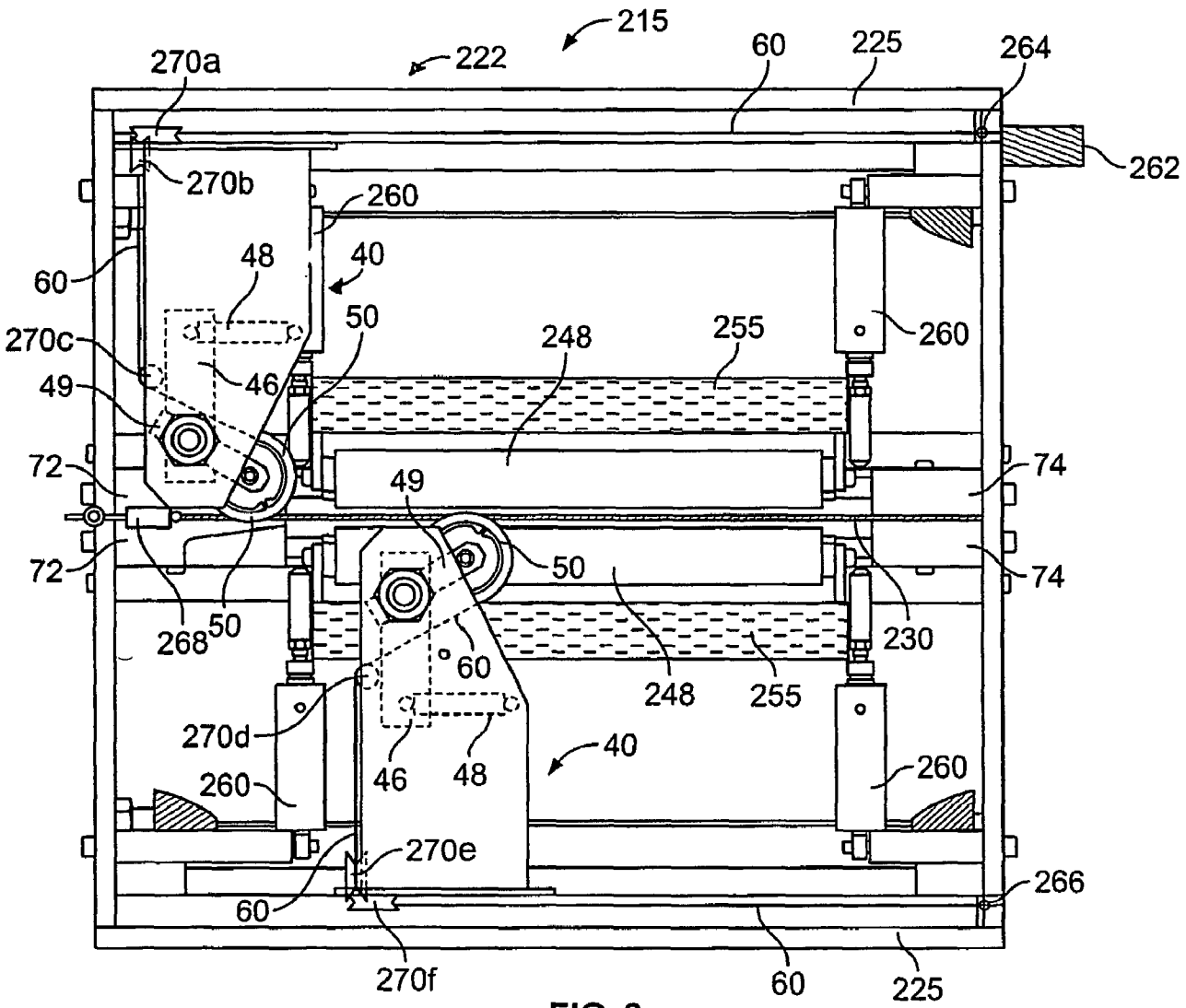
FIG. 6 illustrates a top view of the illustrated embodiment of the present invention incorporated into a splicing apparatus.

As shown in FIGS. 5A, 5B, and 6, the present invention is particularly suitable for use with, but not limited to, a web splicer 210 configured for a continuous web processing operation, whereby the leading end of a web from a new roll of material and the trailing end of web from an expiring roll of material are both expeditiously trimmed or cut and subsequently joined together via a butt joint. The web splicer 210 includes an unwind stand 212, a splicing apparatus 215, and a storage festoon 220. Rolls of web material 200, 202 are placed onto the spindles 201, 203 of the unwind stand 212. The unwind stand also includes at least one idler roller 204, 205 for each spindle 201, 203, the web material that is mounted onto each spindle 201, 203 being routed around the associated idler roller 204, 205 and towards the splicing apparatus 215. The web material is then threaded between the entrance rollers 206, 207 of the splicing apparatus 215, as shown in FIG. 7, and into the splicing apparatus 215.

FIG. 6 shows the illustrated invention being incorporated into a splicing apparatus 215. The splicing apparatus 215 includes an anvil 230, the anvil 230 being positioned between the splice wheel apparatuses 40 and substantially parallel to the end members 225 of the splicer frame 222. On both sides of the anvil 230 are pivotable nip rolls 248. When in the open position, the nip rolls 248 permit the web material to pass along the sides of the anvil 230. However, when a web of material is to be trimmed or cut, the nip roll 248 located adjacent to that material is pivoted via the activation of power cylinders 260 to a closed position against the side of the anvil 230, whereby the nip roll 248 holds the web material during the splicing operation.

When threading a new roll of web material, also referred to hereinafter as non-running web material, the web material may be manually pulled up and over one of the two second-side tape rollers 208, 209 until the web material threaded through the splicing apparatus 215 is taut, at which time the nip roll 248 adjacent to the new web material maybe pivotably moved to a closed positioned to secure a portion of the web material from the new roll of non-running web material against the anvil 230. In one embodiment of the invention, the activation of the nip roll 248 may be achieved by the movement of a shear wheel assembly 40, said movement activating a sensor such as a whisker valve that actuates power cylinders 260 that are operably connected to the nip roll 248 that is adjacent to the web material that is to be trimmed or cut. The nip roll 248 is then pivoted to a closed position whereby the nip roll 248 secures a portion of the web material against the anvil 230.

The linear movement of the shear wheel assembly 40 towards and across the web material that is secured against the adjacent first or second side of the anvil 230 may occur via an operator manually moving the shear wheel assembly 40. Alternatively, each shear wheel assembly 40, may be connected to an double acting pneumatic cylinder, whereby the activation of the pneumatic cylinder initiates the linear movement of the shear wheel assembly 40 across the adjacent side of the anvil 230 and secured web material.

Once the shear wheel assembly 40 begins to move from its first position to its second position, the wrapping engagement between the taut drive cable 60 and the shear wheel 50 forces the shear wheel 50 to spin. During this movement, the locking engagement of the cable terminators 263, 266 with the distal ends of the threaded drive cable 60, along with any additional tension springs, assists in maintaining the desired tautness of the threaded drive cable, while also assuring that additional attached drive cable 60 that is located in the cable spool 262 is not pulled into the splicer frame 222. Upon engagement with the anvil 230, the combination of the continuous movement of the shear wheel assembly 40 and the wrapping engagement of the shear wheel 50 with the taut threaded drive cable 60 forces the shear wheel 50 to continue to rotate, thereby ensuring that the shear wheel 50 will be rotated along, and not pushed across, the anvil 230. This continuous rotational movement of the shear wheel 50 is at least as fast, if not faster than what is achieved when the shear wheel 50 merely rolls across the anvil 230, and thereby allows for an accurate and even cut across the web material.

Once the shear wheel 50, and attached rotary cutting edge 52, has completely run across the leading end of the trimmed web material, and the shear wheel assembly 50 has reached its second position against a stop 74, the excess cut or trimmed web material is removed. The leading end of the trimmed web is now substantially even with or congruent to the cutting edge of the anvil 230. A first piece of tape is then applied to the leading end, the first piece of tape preferably being as long as the width of the web material. The first piece of tape is applied to the trimmed web material so that approximately one-half of the thicknesses of the first piece of tape extends beyond the cutting edge of the anvil 230. A backup bar 255 then engages and supports the trimmed web material and the first piece of tape. Furthermore, in the illustrated embodiment, once the leading edge has been trimmed, the shear wheel assembly 40 may be returned from its second position to its first position.

In preparation for trimming the trailing end of the expiring roll, a web splicer 210 such as that illustrated in FIGS. 5A, 5B, 6, and 7 often incorporates second-side tape rollers 208, 209, that are positioned downstream of the splicing apparatus 215, as illustrated in FIGS. 5A and 7. These second-side tape rollers 208, 209 often have vacuum holes configured to hold onto the non-adhesive side of the second piece of tape. In operation, the second piece of tape is applied to the second-side tape roller 208, 209 that is adjacent to the expiring roll of web material.

Once the second piece of tape is positioned on the vacuum holes of the second-side tape roller 208, 209, the operator must make the decision as to when to initiate the splicing of the trailing end of the expiring web. Once this decision is made, the operator pushes a switch that activates the power cylinders 260 that are operably connected to the nip roll 248 that is adjacent to the expiring web of material. The nip roll 248 is then pivoted to a closed position that secures a portion of the expiring web material against the anvil 230. Once secured, the shear wheel assembly 40 that is adjacent to the expiring roll of web material begins rapidly moving from its first position to its second position. Again, the combination of the movement of the shear wheel assembly 40 and the wrapping engagement between the shear wheel 50 and the taut threaded drive cable 60 forces the shear wheel 50, and associated rotary cutting edge 52 to spin. The movement of the shear wheel assembly 50 across the web material causes the rotary cutting edge 52 to cut the trailing end of the web material along the cutting edge of the anvil 230.

The engagement of the shear wheel 50 with the expiring web, and particularly the point of cutting contact, forces the trimmed trailing end, which is located above the cutting edge of the anvil 230, against the upper half of the first piece of tape that was applied to the leading end of the new web material, thereby abutting the trailing end of the expiring web with the leading end of the new roll of web material. Once the shear wheel assembly 40 that has cut the expiring web reaches its second position, a sensor, such as a whisker valve, deactivates both nip bars 248 and the backup bar 255 so that the newly spliced butt joint may run through the remainder of the web splicer 210 and towards the storage festoon 220. As the butt joint passes by the second-side tape rollers 208, 209, the second piece of tape that is being held by the vacuum holes of at least one of the second-side tape rollers 208, 209 is applied to the joint.

While the invention has been described in connection with one or more embodiments, it will be understood that the invention is not limited to those embodiments. On the contrary, the invention includes all alternatives, modifications, and equivalents as may be included within the spirit and scope of the appended claims.

What is claimed:

1. An improved apparatus for forming a butt joint to join together the leading end of a web from a new roll of material to the trailing end of a web from an expiring roll of material for use with lightweight web materials, the web of the expiring roll being run downstream from the expiring roll under tension along a predetermined path of travel, the improved apparatus comprising:

a. a splicer frame that includes at least one side member and at least one end member, the at least one side member operably connected to the at least one end member;

b. an anvil operably connected to the splicer frame, at least one side of the anvil being disposed adjacent to the path of travel of the web from the new roll and the web of the expiring roll, the anvil having a cutting edge;

c. at least one shear wheel assembly operably connected to the splicer frame, the at least one shear wheel assembly comprising a shear wheel, the shear wheel having a rotary cutting edge, the at least one shear wheel adapted to move along the anvil, the shear wheel assembly configured for movement from the proximity of an adjacent at least one side member to the proximity of another at least one side member, the rotary cutting edge adapted for movement along a path substantially parallel to the cutting edge;

d. at least one drive cable, at least a portion of the at least one drive cable being threaded through the splicer frame, at least a portion of the at least one drive cable threaded through the splicer frame being wrapped around at least a portion of the shear wheel; and e. at least one cable terminator operably connected to the splicer frame, the at least one cable terminator configured to secure at least a portion of the at least one drive cable and to maintain tension on the at least one drive cable.

2. The apparatus of claim 1 wherein the at least one shear wheel assembly comprises a first shear wheel assembly and a second shear wheel assembly, the first shear wheel assembly being positioned adjacent a first side of the anvil, the second shear wheel assembly being positioned adjacent to a second side of the anvil.

3. The apparatus of claim 1 wherein the shear wheel includes a circumferential groove, the circumferential groove configured for engagement of at least a portion of the at least one drive cable.

4. The apparatus of claim 1 which includes a cable tensioning spring operably connected to the splicer frame, the cable tensioning spring configured to exert a tension force on the at least one drive cable.

5. The apparatus of claim 1 including a cable spool operably connected to the splicer frame, the cable spool including a plurality of excess drive cable operably connected to the at least one drive cable.

6. An improved apparatus for forming a butt joint to join together the leading end of a web from a new roll of material to the trailing end of a web from an expiring roll of material for use in lightweight web material and disposable diaper operations, the web of the expiring roll being run downstream from the expiring roll under tension along a predetermined path of travel, the improved apparatus comprising:

a. a splicer frame, the splicer frame having at least two side members and at least two end members;

b. an anvil operably connected to the splicer frame, the plane of the anvil being generally perpendicular to the plane of the splicer frame, the anvil being disposed adjacent to the path of travel of the web from the new roll and the expiring roll, the anvil having a first side, a second side, and a cutting edge, the cutting edge having a width at least equal to the width of the web, the cuffing edge being positioned downstream of the first side and the second side, the first side being substantially parallel to the second side;

c. at least one drive cable, at least a portion of the at least one drive cable being threaded about the splicer frame to create a threaded drive cable, the threaded drive cable having a plurality of distal ends;

d. at least one shear wheel assembly operably connected to the splicer frame, the at least one shear wheel assembly comprising a shear wheel, the shear wheel being biased for engagement with at least one side of the anvil, the shear wheel having a lower edge and a circumferential groove, the lower edge having a rotary cutting edge, the circumferential groove being configured to accept at least a portion of the at least one drive cable; and e. at least one cable terminator operably connected to the splicing frame, the at least one cable terminator configured to secure at least one of the plurality of distal ends, the at least one cable terminator configured to maintain tension on the threaded drive cable.

7. The apparatus of claim 6 wherein the at least one shear wheel assembly comprises a first shear wheel assembly and a second shear wheel assembly, the first shear wheel assembly being positioned adjacent to the first side of the anvil, the second shear wheel assembly being positioned adjacent to the second side of the anvil.

8. The apparatus of claim 6 which includes a cable tensioning spring operably connected to the splicer frame, the cable tensioning spring configured to exert a tension force on the threaded drive cable.

9. The apparatus of claim 6 including a cable spool operably connected to the splicer frame, the cable spool including a plurality of excess drive cable operably connected to the threaded drive cable.

10. An improved method for forming a butt joint to join together the leading end of a web from a new roll of material to the trailing end of a web from an expiring roll of material for use in lightweight web material and disposable diaper operations, the web of the expiring roll being run downstream from the expiring roll under tension along a predetermined path of travel, the method comprising the steps of:

a. threading a drive cable through a splicer frame and at least one shear wheel assembly, the at least one shear wheel assembly having a shear wheel, the shear wheel having a rotary cutting edge;

b. wrapping at least a portion of the threaded drive cable around at least a portion of the shear wheel;

c. tensioning the threaded drive cable to obtain tautness in the threaded drive cable;

d. locking the threaded drive cable at two distal ends to maintain tautness of the threaded drive cable;

e. securing a portion of web from the new roll against an anvil, the anvil including a cutting edge;

f. moving the at least one shear wheel assembly from a first position to a second position, the movement of the at least one shear wheel assembly and the wrapping engagement between the shear wheel and the drive cable forcing the shear wheel to rotate;

g. trimming a portion of the web from the new roll along the cutting edge of the anvil with the rotary cutter so that a trimmed leading end of the new roll is substantially congruent with the cutting edge of the anvil;

h. applying a first piece of adhesive tape to the trimmed leading end so that a portion of the first piece of tape extends downstream beyond the cutting edge of the anvil and beyond the trimmed leading end;

i. stopping a portion of the web from the expiring roll while maintaining tension in the web from the expiring roll located downstream of the stopped portion of the stopped web from the expiring roll;

j. securing a portion of the stopped web from the expiring roll of material against the adjacent anvil;

k. trimming the web from the expiring roll with the rotary cutting edge of the shear wheel along the cutting edge of the anvil so that a trimmed trailing end of the expiring roll is aligned with and conforms to the cutting edge of the anvil;

l. adhering the trimmed trailing end of the expiring roll to the downstream portion of the first piece of tape, the cut portion of the trimmed trailing end substantially simultaneously being adhered to the first piece of tape as the point of cutting moves across the secured expiring roll, the first piece of adhesive tape securing together the leading end of the new roll and the trailing end of the expiring roll, the trimmed trailing end of the expiring roll adhered to the tape abuts and is disposed closely adjacent to the trimmed leading end of the new roll of material; and m. releasing the new roll and the expiring roll from the anvil so as to permit the joined expiring and new roll to travel together along the path of further downstream portions of the web from the expiring roll.

11. The method of claim 10 including the further step of adhering a second piece of tape to the trimmed leading end of the new roll and the trimmed trailing end of the expiring roll on the side of the joined web opposite of that of the first piece of tape, the second piece of tape being adhered to the joined web after the joined web has commenced following the downstream portions of web from the expiring roll.

* * * * *